US011905046B2

(12) United States Patent
Gibson et al.

(10) Patent No.: US 11,905,046 B2
(45) **Date of Patent: *Feb. 20, 2024**

(54) SYSTEMS AND METHODS FOR WRAPPING AN OBJECT

(71) Applicant: Mt. Adams Orchards Corporation, White Salmon, WA (US)

(72) Inventors: Don M. Gibson, Yakima, WA (US); Doug G. Gibson, Yakima, WA (US); Shane C. Dittrich, Nampa, ID (US); Kristopher R. Okelberry, Nampa, ID (US); Michael P. Baker, Nampa, ID (US); Peter O. Ashworth, Nampa, ID (US); Mark E. De Kleine, Prosser, WA (US); Tyler Dale, Nampa, ID (US)

(73) Assignee: Mt. Adams Orchards Corporation, White Salmon, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/657,866

(22) Filed: Apr. 4, 2022

(65) Prior Publication Data

US 2022/0332449 A1 Oct. 20, 2022

Related U.S. Application Data

(63) Continuation of application No. 16/271,646, filed on Feb. 8, 2019, now Pat. No. 11,319,096.

(51) Int. Cl.
*B65B 11/54* (2006.01)
*B65B 41/14* (2006.01)
(Continued)

(52) U.S. Cl.
CPC ..... *B65B 11/02* (2013.01); *B65B 41/14* (2013.01); *B65B 57/00* (2013.01); *B65B 61/06* (2013.01)

(58) Field of Classification Search
CPC ..... B65B 11/54
(Continued)

(56) References Cited

U.S. PATENT DOCUMENTS 1,424,363 A * 8/1922 Leumann ..... B65B 11/54 53/226
2,009,241 A 7/1935 Roberts
(Continued)

FOREIGN PATENT DOCUMENTS

| | | |
|---|---|---|
| CN | 201037050 Y | 3/2008 |
| CN | 104709500 B | 1/2017 |
| GB | 0 178 327 | 4/1922 |

OTHER PUBLICATIONS

International Search Report and Written Opinion dated May 7, 2020 for international application PCT/US2019/068033.

*Primary Examiner* — Thanh K Truong
*Assistant Examiner* — Patrick B Fry
(74) *Attorney, Agent, or Firm* — Foley & Lardner LLP

(57) ABSTRACT

Systems and method of wrapping an object are disclosed. An object wrapping system includes a contractible loop, a positioning system, and a wrapping material system. The contractible loop is configured to be deployed in an expanded position and a contracted position. The positioning system is configured to position an object in alignment with an aperture defined by the contractible loop. The wrapping material system is configured to position a wrapping material between the object and the aperture. The positioning system is configured to move the object into the wrapping material and through the aperture when the contractible loop is deployed in the expanded position. The contractible loop is configured to deploy into the contracted position to at least partially close the wrapping material around the object.

20 Claims, 15 Drawing Sheets

(51) Int. Cl.
*B65B 61/06* (2006.01)
*B65B 11/02* (2006.01)
*B65B 57/00* (2006.01)

(58) Field of Classification Search
USPC ..... 53/466, 228
See application file for complete search history.

(56) References Cited

U.S. PATENT DOCUMENTS

| | | | | | |
|---|---|---|---|---|---|
| 4,035,985 | A | | 7/1977 | Aoyama et al. | |
| 4,178,740 | A | | 12/1979 | Groom et al. | |
| 4,674,269 | A | | 6/1987 | Denda | |
| 4,813,211 | A | | 3/1989 | Treiber | |
| 4,827,694 | A | | 5/1989 | Owen et al. | |
| 4,999,977 | A | | 3/1991 | Briscoe et al. | |
| 5,473,861 | A | * | 12/1995 | Fukunaga | B65B 11/54 53/228 |
| 5,528,881 | A | * | 6/1996 | Cappi | B65B 11/54 53/464 |
| 7,000,370 | B2 | | 2/2006 | Bryant et al. | |
| 2002/0148365 | A1 | | 10/2002 | Squyres | |
| 2014/0250831 | A1 | | 9/2014 | Suolahti et al. | |
| 2016/0278295 | A1 | | 9/2016 | Johnson | |

* cited by examiner

SYSTEMS AND METHODS FOR WRAPPING AN OBJECT

RELATED APPLICATIONS

This application is a continuation of U.S. patent application Ser. No. 16/271,646, filed Feb. 8, 2019 and titled SYSTEMS AND METHODS FOR WRAPPING AN OBJECT, which is incorporated herein by reference in its entirety

BACKGROUND

Various different types of products are wrapped before distribution to sale facilities that sell the products or to end users of the products. In some instances, rules, regulations, industry standards, common sense, or convenience may dictate that certain types of products be wrapped before distribution. One example of a product that may be wrapped before distribution is fruit. Some fruits, such as pears, may be hand-wrapped before placement in packaging (e.g., a box) for distribution.

DETAILED DESCRIPTION

Embodiments disclosed herein are directed to systems and methods of wrapping an object. By way of non-limiting example, the object may be wrapped prior to distribution. Although reference is made herein specifically to wrapping fruit, it will be apparent to one of ordinary skill in the art that embodiments disclosed herein extend to wrapping of objects in general, including any objects that are to be wrapped before shipping.

Figure 1:
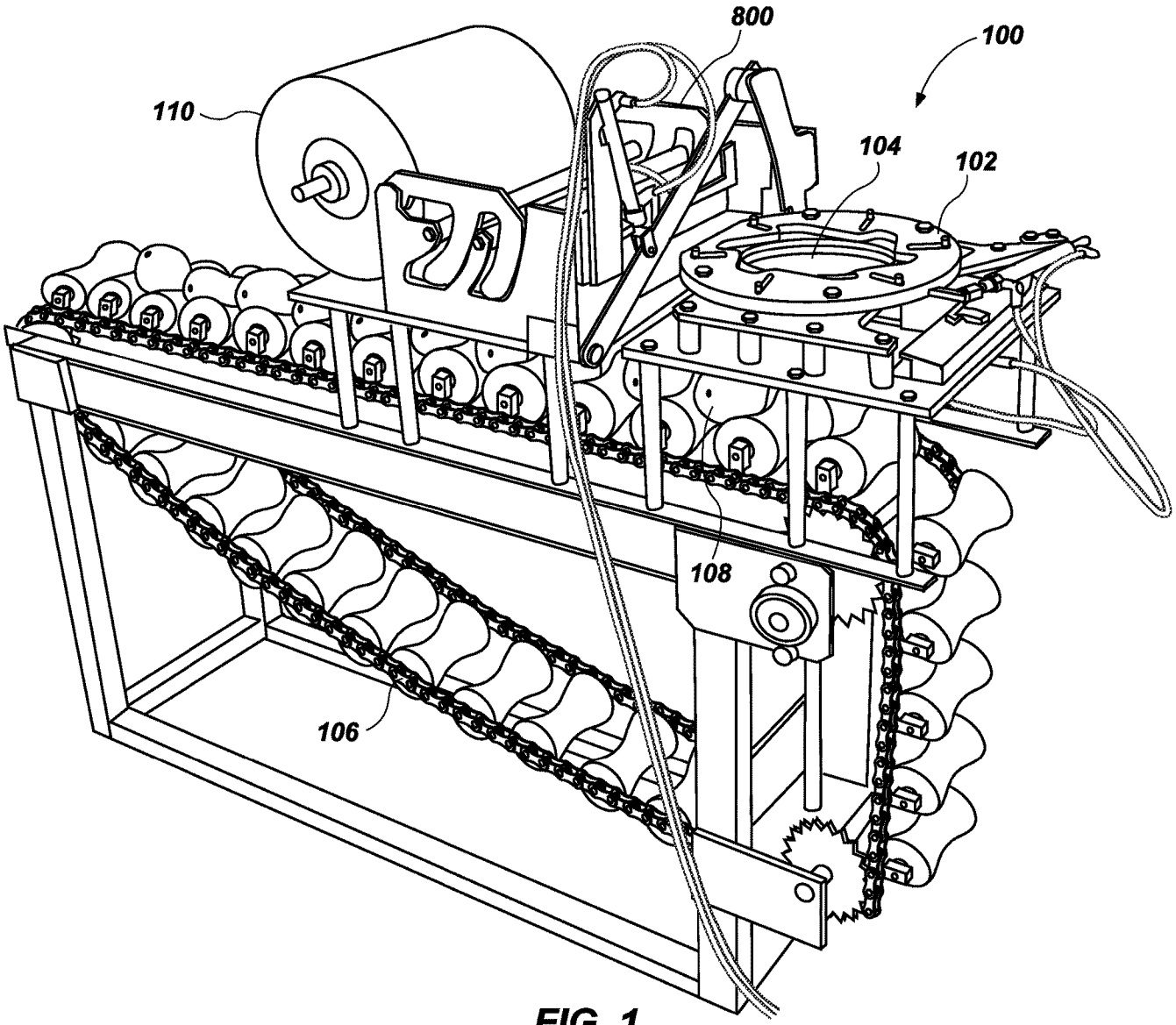
FIG. 1 is a perspective view of an object wrapping system, according to some embodiments.

FIG. 1 is a block diagram of an object wrapping system 100 in accordance with some embodiments. The object wrapping system 100 includes a contractible loop 102, a positioning system 106, and a wrapping material system 800. The contractible loop 102 is configured to be deployed in an expanded position in which an aperture 104 defined by the contractible loop 102 has a first area. The contractible loop 102 is also configured to be deployed in a contracted position in which the aperture 104 has a second area that is smaller than the first area. The wrapping material system 800 is configured to at least partially wrap an object 108 with a wrapping material 110.

In operation, the positioning system 106 positions the object 108 in alignment with the aperture 104 and the wrapping material system 800 positions the wrapping material 110 between the object 108 and the aperture 104. With the contractible loop 102 deployed in the expanded position, the positioning system 106 moves the object 108 into the wrapping material 110 and through the contractible loop 102. The contractible loop 102 at least partially closes the wrapping material 110 around the object 108.

The aperture 104 is sufficiently large to enable the object 108 to pass through the aperture 104 when the contractible loop 102 is deployed in the expanded position. In some embodiments, the aperture 104 is also sufficiently small to prevent the object 108 from passing through the aperture 104 while the contractible loop 102 is deployed in the contracted position.

In some embodiments, the contractible loop 102 has an at least substantially annular shape. As used herein the term "substantially" indicates an accuracy within a tolerance such as thirty percent (30%), twenty percent (20%), ten percent (10%), five percent (5%), three percent (3%), two percent (2%), one percent (1%), or any of various fractions of one percent (1%). Accordingly, the term "at least substantially annular" refers to any shape that has dimensions that do not deviate from a perfect annulus more than a predetermined tolerance amount. In some embodiments, the contractible loop 102 has a shape different from an annular shape. By way of non-limiting example, the contractible loop 102 may be shaped in an at least substantially elliptical loop, an at least substantially rectangular (e.g., square) loop, an at least substantially triangular loop, an asymmetrically shaped loop, a symmetrically shaped loop, other polygonally shaped loops of various numbers of sides, or other shapes. It should be noted that although the contractible loop 102 of FIG. 1 is illustrated as forming a continuous structure around the aperture 104, the contractible loop 102 may in some embodiments form only an intermittent structure around the aperture 104. It should also be noted that although the contractible loop 102 of FIG. 1 is illustrated as being oriented in an at least substantially horizontal orientation, the contractible loop 102 may in some embodiments be oriented in an at least substantially vertical orientation, or at some acute angle from a horizontal or vertical orientation.

Figure 2:
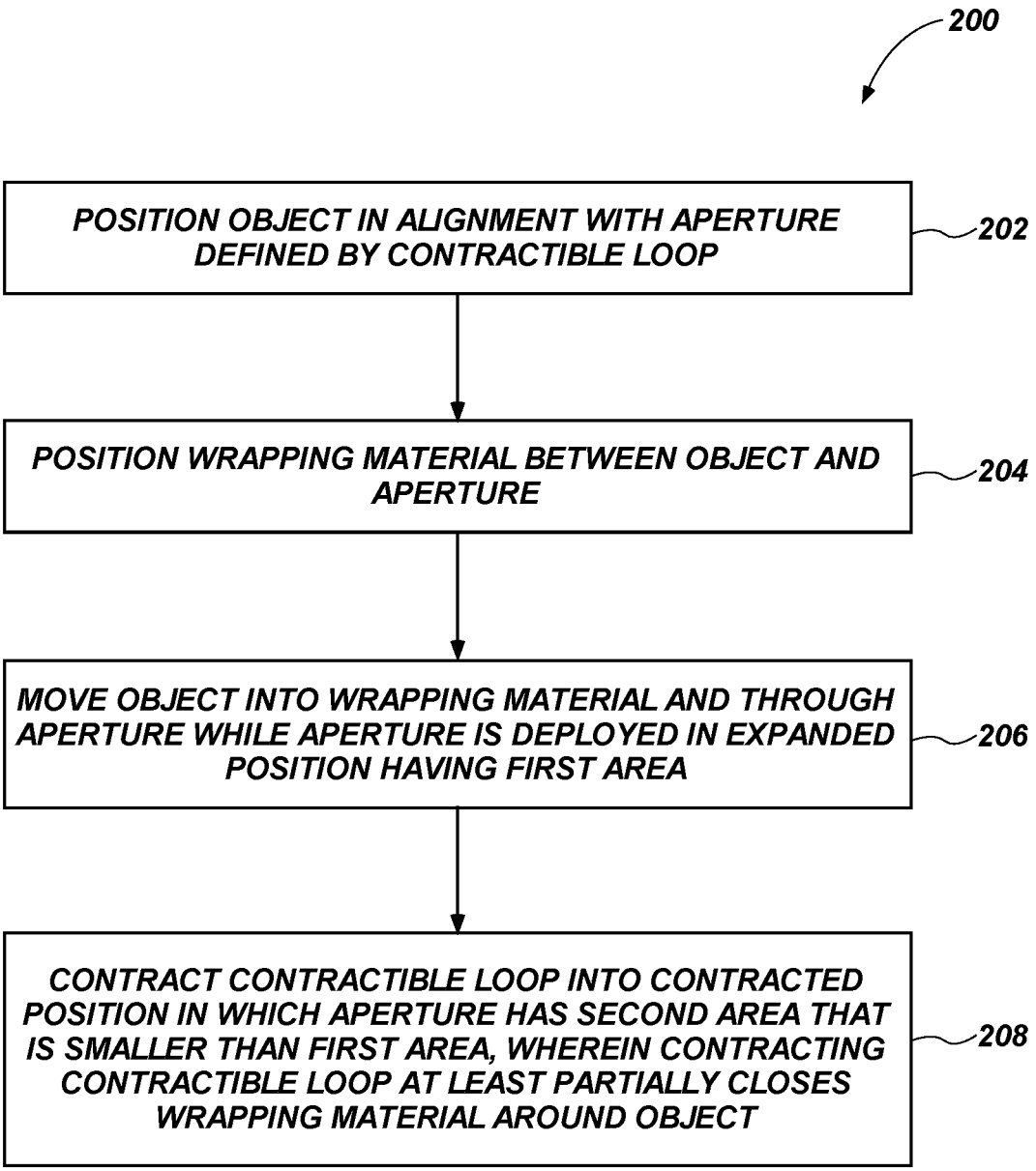
FIG. 2 is a flowchart illustrating a method of wrapping an object, according to some embodiments

FIG. 2 is a flowchart illustrating a method 200 of wrapping an object 108, according to some embodiments. FIGS. 3-6 illustrate acts (e.g., positioning 202, positioning 204, moving 206, and contracting 208) of the method 200. FIGS. 3-6 are simplified perspective views of the object wrapping system 100 of FIG. 1, according to some embodiments.

Figure 3:
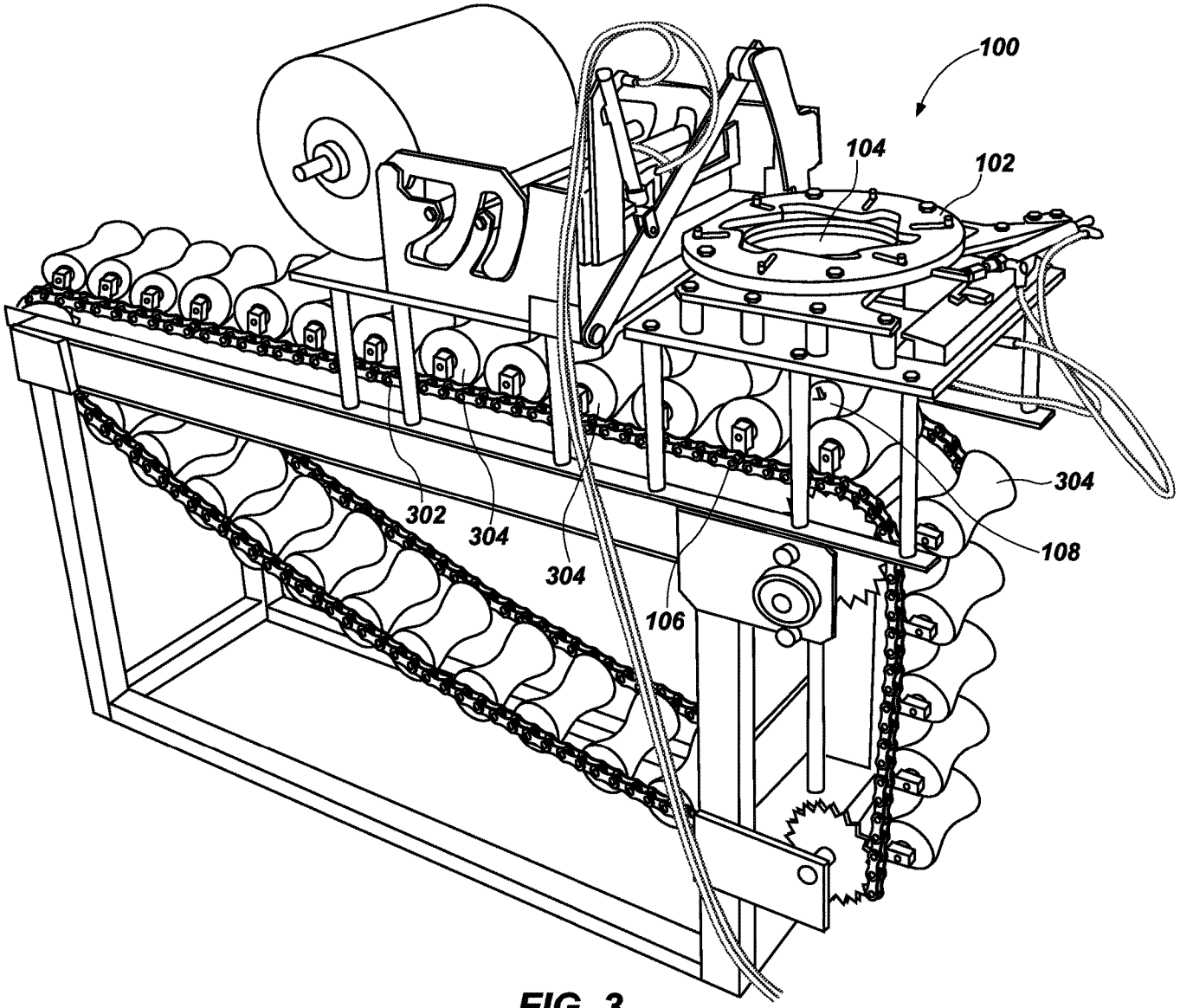
FIG. 3 is a perspective view of the object wrapping system of FIG. 1, according to some embodiments.

Referring to FIGS. 2 and 3 together, the method 200 comprises positioning 202 an object 108 in alignment with an aperture 104 defined by a contractible loop. In the example of FIG. 3, the object 108 is positioned, by a positioning system 106, underneath the aperture 104 of the contractible loop 102. As a result, the object 108 is aligned vertically with the aperture 104. It will be apparent that other alignments other than a vertical alignment of the object 108 below the aperture 104 are possible within the scope of the disclosure. For example, a vertical alignment of the object 108 above the aperture 104 is also contemplated within the scope of the disclosure. Also, horizontal or non-vertical, non-horizontal alignments are also contemplated herein.

The positioning system 106 of the example of FIG. 3 includes a conveyor system including a chain 302 carrying conveyor members 304. In the example of FIG. 3, the conveyor members 304 are dumbbell-shaped to permit the object 108 to rest in a gap formed between an adjacent pair of the conveyor members 304. In this configuration, the conveyor members 304 may be positioned more closely together when positioning 202 a relatively small object 108, and further apart when positioning 202 a relatively larger object 108. As is apparent from inspection of the positioning system 106 of FIG. 3, an object 108 may be carried between each pair of the conveyor members 304 (e.g., as illustrated in FIG. 1).

Figure 4:
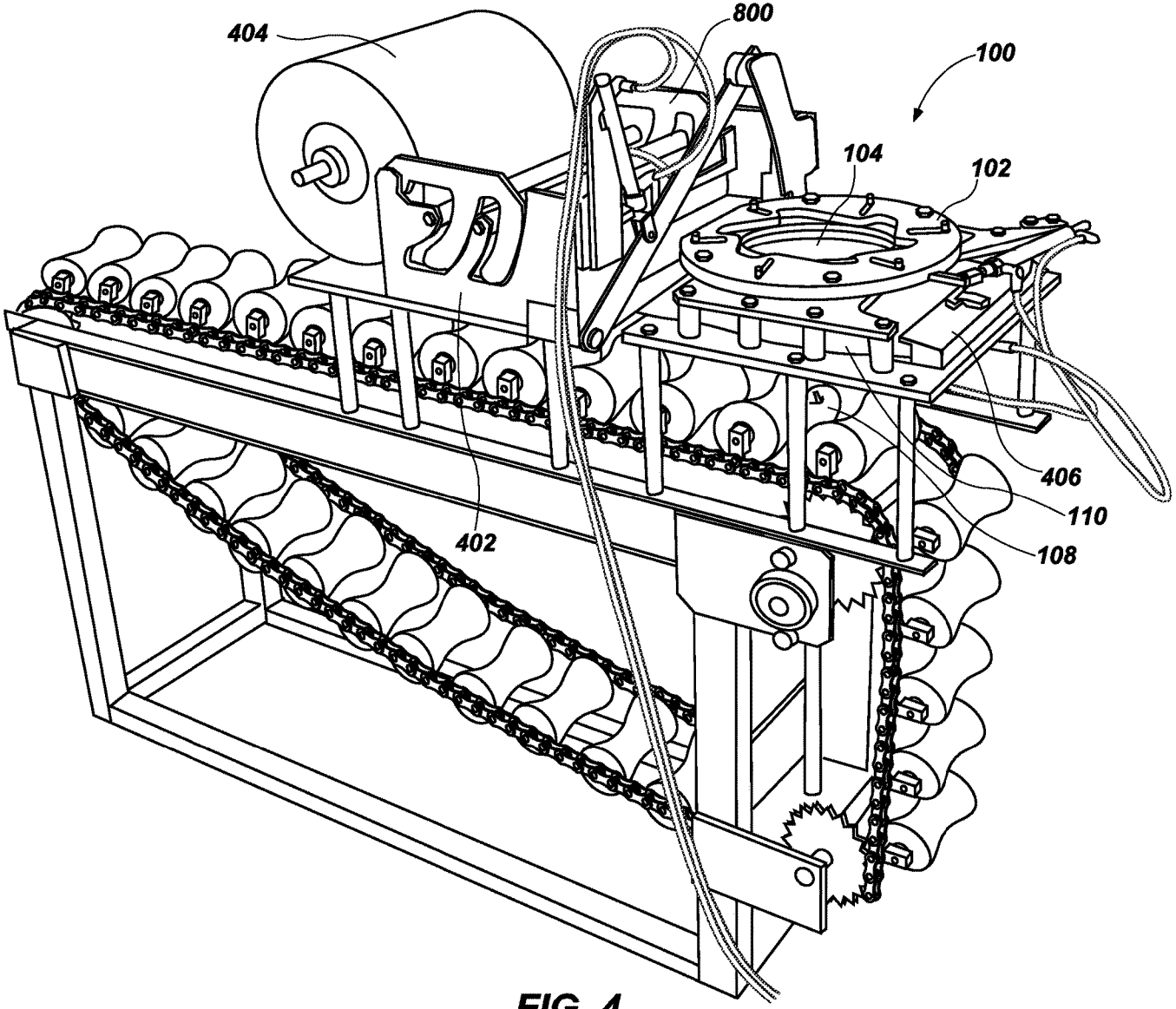
FIG. 4 is a perspective view of the object wrapping system of FIG. 1, according to some embodiments.

Referring to FIGS. 2 and 4 together, the method 200 also includes positioning 204 a wrapping material 110 between the object 108 and the aperture 104. FIG. 4 illustrates the wrapping material 110 positioned 204 between the object 108 and the aperture 104 of the contractible loop 102. The example object wrapping system 100 of FIG. 4 includes a wrapping material system 800 configured to position 204 the wrapping material 110 between the object 108 and the aperture 104. The wrapping material system 800 includes a dispenser 402 of the wrapping material 110, a roll of wrapping material 404, and a wrapping material positioning member 406. In some embodiments, positioning 202 the object 108 occurs before positioning 204 the wrapping material 110. In some embodiments, positioning 202 the object 108 and positioning 204 the wrapping material 110 at least partially overlap in times of their performance. In some embodiments, positioning 204 the wrapping material 110 is performed before positioning 202 the object 108. More detail regarding the wrapping material system 800 is discussed below with reference to FIGS. 7-12.

Figure 5:
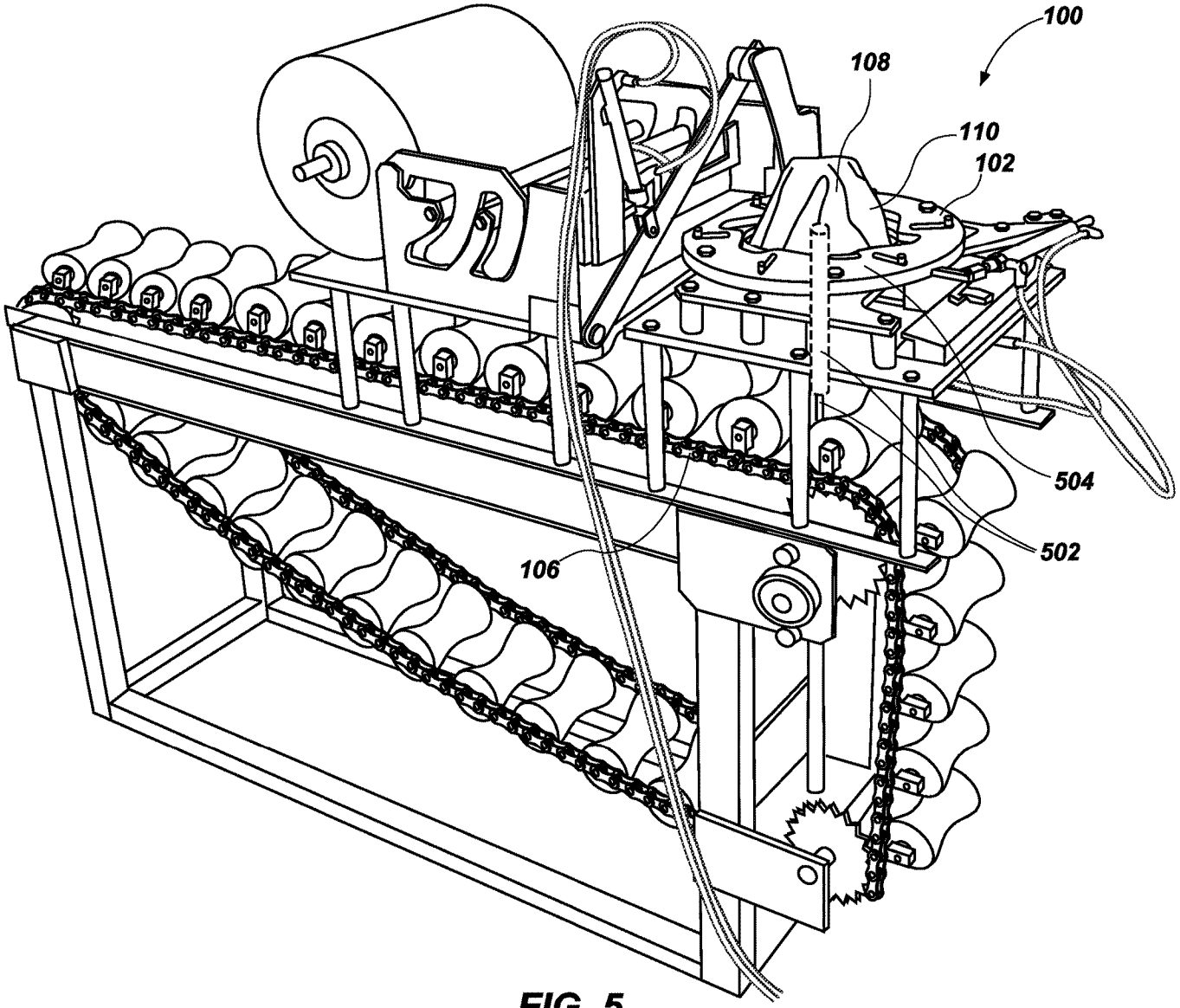
FIG. 5 is a perspective view of the object wrapping system of FIG. 1, according to some embodiments.

Referring to FIGS. 2 and 5 together, the method 200 further includes moving 206 the object 108 into the wrapping material 110 and through the aperture 104 while the aperture 104 is deployed in an expanded position having a first area. The first area of the aperture 104 deployed in the expanded position is sufficiently large to enable the object 108 to pass therethrough. FIG. 5 illustrates the object 108 after being moved into the wrapping material 110 and through the aperture 104.

As illustrated in FIG. 5, the contractible loop 102 applies a mechanical resistance against the wrapping material 110 except in the location of the aperture 104 as the object 108 is moved 206 through the aperture 104. As a result, the wrapping material 110 wraps partially around the object 108, as shown in FIG. 5. In some embodiments the contractible loop 102 includes a rigid annular member 504 to provide mechanical support to the contractible loop 102 as the object 108 moves through the aperture 104.

In some embodiments, the positioning system 106 includes an object moving device 502 such as a pushing member. The object moving device 502 illustrated in FIG. 5 includes a rod configured to pass between the conveyor members 304 supporting the object 108, and push the object 108 into the wrapping material 110 and through the aperture 104. In some embodiments the object moving device 502 may be configured to rotate the object 108 as or after the object moving device 502 moves 206 the object 108 into the wrapping material 110.

In some embodiments, the contractible loop 102 may be adjustable to accommodate objects of different sizes. For example, the object wrapping system 100 may be used to wrap fruit to prepare the fruit for packaging and shipping. It will be apparent that different types of fruit may have different ranges of sizes associated therewith. In the example illustrated by FIG. 5, the object 108 includes a pear. If it were desired to use the object wrapping system 100 to wrap a larger fruit (e.g., a grapefruit, a cantaloupe, etc.), the contractible loop 102 may be adjusted so that the aperture 104 has a first area that is sufficiently large to accommodate the size of the larger fruit while deployed in the expanded position. Similarly, if it were desired to use the object wrapping system 100 to wrap a smaller fruit (e.g., a tangerine, a strawberry, etc.), the contractible loop 102 may be adjusted so that the aperture 104 has a first area that is appropriate to accommodate the smaller fruit.

In some embodiments moving 206 the object 108 into the wrapping material 110 and through the aperture 104 may be performed differently than illustrated in FIG. 5. By way of non-limiting example, a conveyer system could merely drop the object through the contractible loop 102 with a wrapping material 110 over the contractible loop 102. Also by way of non-limiting example, the object 108 could be moved (e.g., vertically, horizontally, or some non-vertical, non-horizontal direction) into the wrapping material 110 and through the aperture 104 by an object moving device that carries the object in some way (e.g., a suction cup, a piercing member, a gripper, etc.). In some embodiments, a person may manually move 206 the object 108 into the wrapping material 110 and through the aperture 104 by clasping the object 108 in a hand and moving 206 the object 108.

Figure 6:
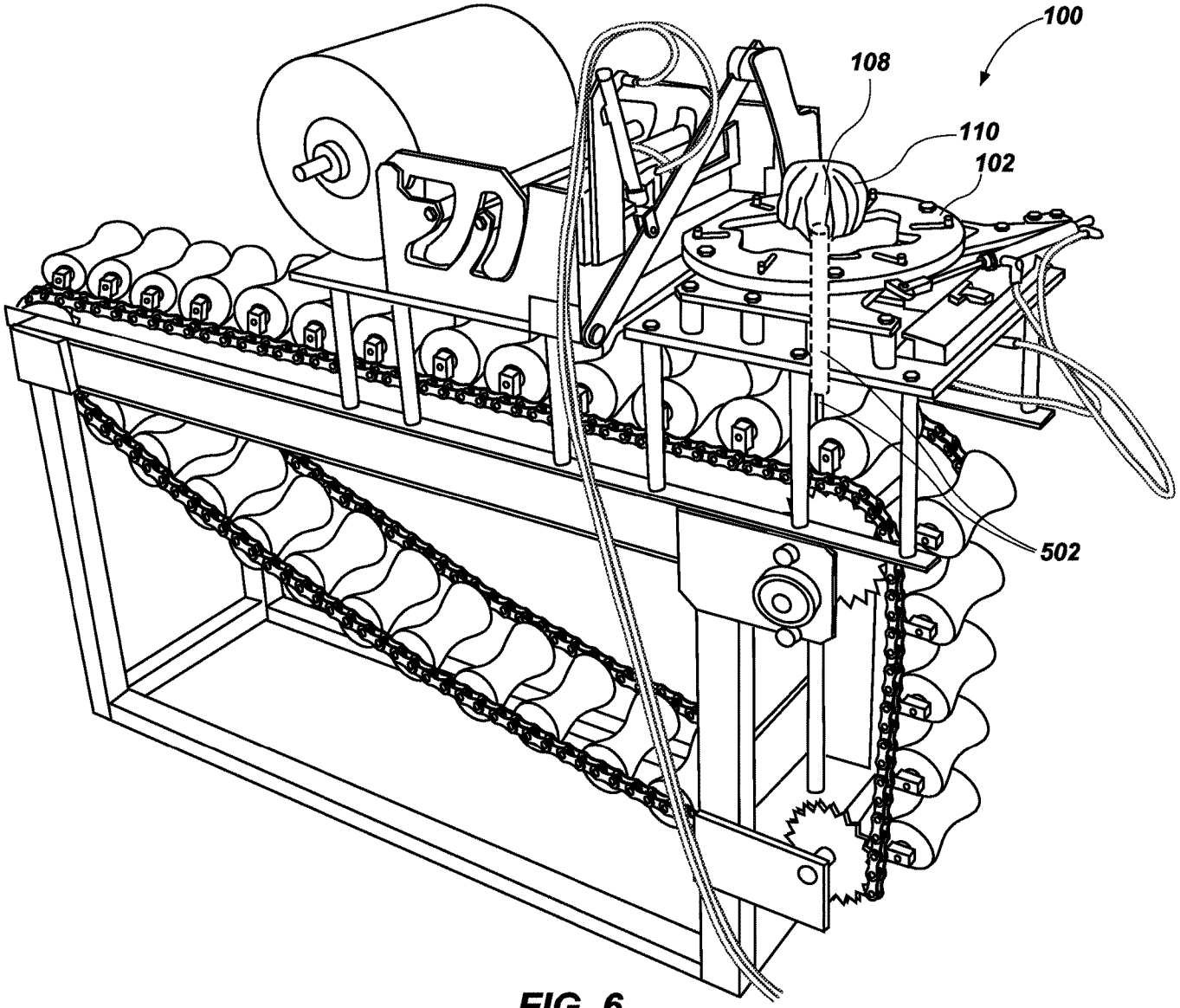
FIG. 6 is a perspective view of the object wrapping system of FIG. 1, according to some embodiments.

Referring to FIGS. 2 and 6 together, the method 200 also includes contracting 208 the contractible loop 102 into a contracted position in which the aperture 104 has a second area that is smaller than the first area. As shown in FIG. 6, contracting 208 the contractible loop 102 at least partially closes the wrapping material 110 around the object 108. In some embodiments, the contractible loop 102 may be configured to rotate to assist in the closing of the wrapping material 110 around the object 108. In some embodiments the second area of the aperture 104 may be sufficiently small to prevent the object 108 from passing back through the aperture 104 after the contractible loop 102 contracts 208. In some embodiments, contracting 208 the contractible loop 102 into the contracted position includes extending a plurality of retractable members positioned in an at least substantially annular orientation from a retracted position to an extended position.

In some embodiments the object wrapping system 100 may be configured to secure the wrapping material 110 in a closed position. For example, the object wrapping system 100 may be configured to deliver a tie (e.g., a zip tie, a twist tie, a rubber band, etc.), a staple, a clip, or other securing mechanism to secure the wrapping material 110 in the closed position.

In some embodiments, the object moving device 502 (e.g., the pushing member) is sufficiently small to pass back through the aperture 104 after the contractible loop 102 contracts 208 into the contracted position to close the wrapping material 110 around the object 108. In some embodiments, the object moving device 502 may be configured to retract back through the aperture 104 while or after the contractible loop 102 contracts 208.

In some instances, the orientation of the object 108 itself within the object wrapping system 100 may be important. For example, it may be desirable for certain types of objects 108 to be packaged in a certain orientation, or moved 206 into the wrapping material 110 in a certain orientation. As a specific, non-limiting example, in embodiments where the object 108 includes a fruit, it may be desirable to orient the object 108 so that a stem or some other sharp or abrasive portion of the object 108 does not lead as the object 108 is moved 206 into the wrapping material 110 (e.g., to limit or prevent damaging the wrapping material 110). As another specific, non-limiting example, certain objects 108 may include delicate or breakable portions, and an orientation of the object 108 as it is manipulated by the object wrapping system 100 may be important to limit or prevent damage to the object 108. Accordingly, in some embodiments the object wrapping system 100 is configured to identify an orientation of the object 108 (e.g., as positioned 202, as moved 206, or as packaged after being wrapped). In some embodiments, the object wrapping system 100 may be configured to change an orientation of the object 108. By way of non-limiting example, the object moving device 502 may be configured to manipulate the object 108 to change the orientation to a desired orientation.

Also, different objects 108 may benefit from different types of treatment by the object wrapping system 100. For example, in instances where the object 108 is an apple, it may be relatively highly damaging for the apple to be dropped, but relatively less damaging for the apple to be scratched. In contrast, in instances where the object 108 is a pear, it may be relatively highly damaging for the pear to be scratched, but relatively less damaging for the pear to be dropped. Accordingly, the object wrapping system 100 and method 200 may be altered to accommodate the properties of whatever object 108 is wrapped by the object wrapping system 100.

Figure 7:
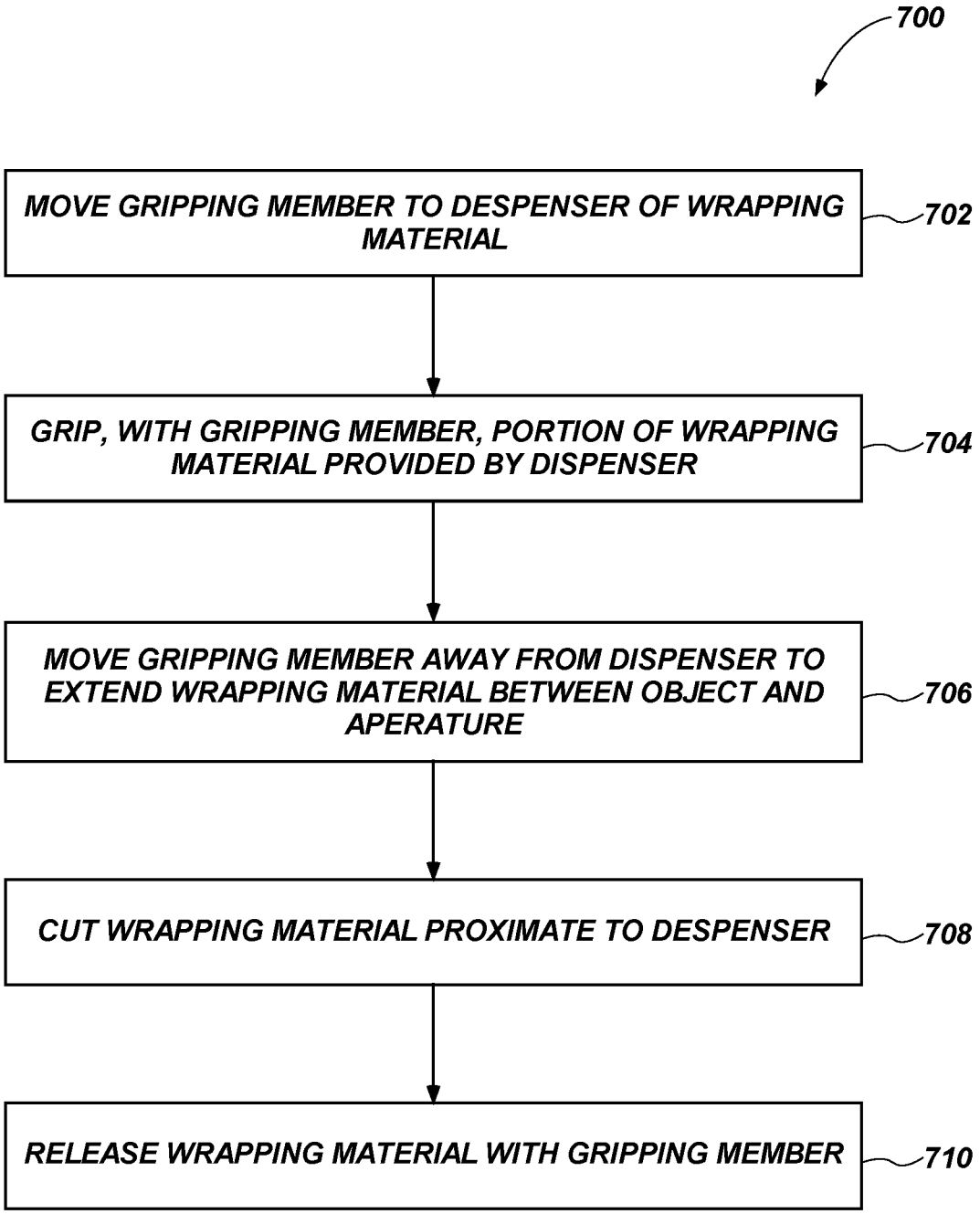
FIG. 7 is a flowchart illustrating a method of positioning a wrapping material between an object and an aperture, according to some embodiments.

FIG. 7 is a flowchart illustrating a method 700 of positioning a wrapping material 110 between an object 108 and an aperture 104, according to some embodiments. FIGS. 8-12 illustrate acts (e.g., moving 702, gripping 704, moving 706, cutting 708) of the method 700. FIGS. 8-12 are perspective views of a wrapping material system 800 of the object wrapping system 100 of FIG. 1, according to some embodiments.

Figure 8:
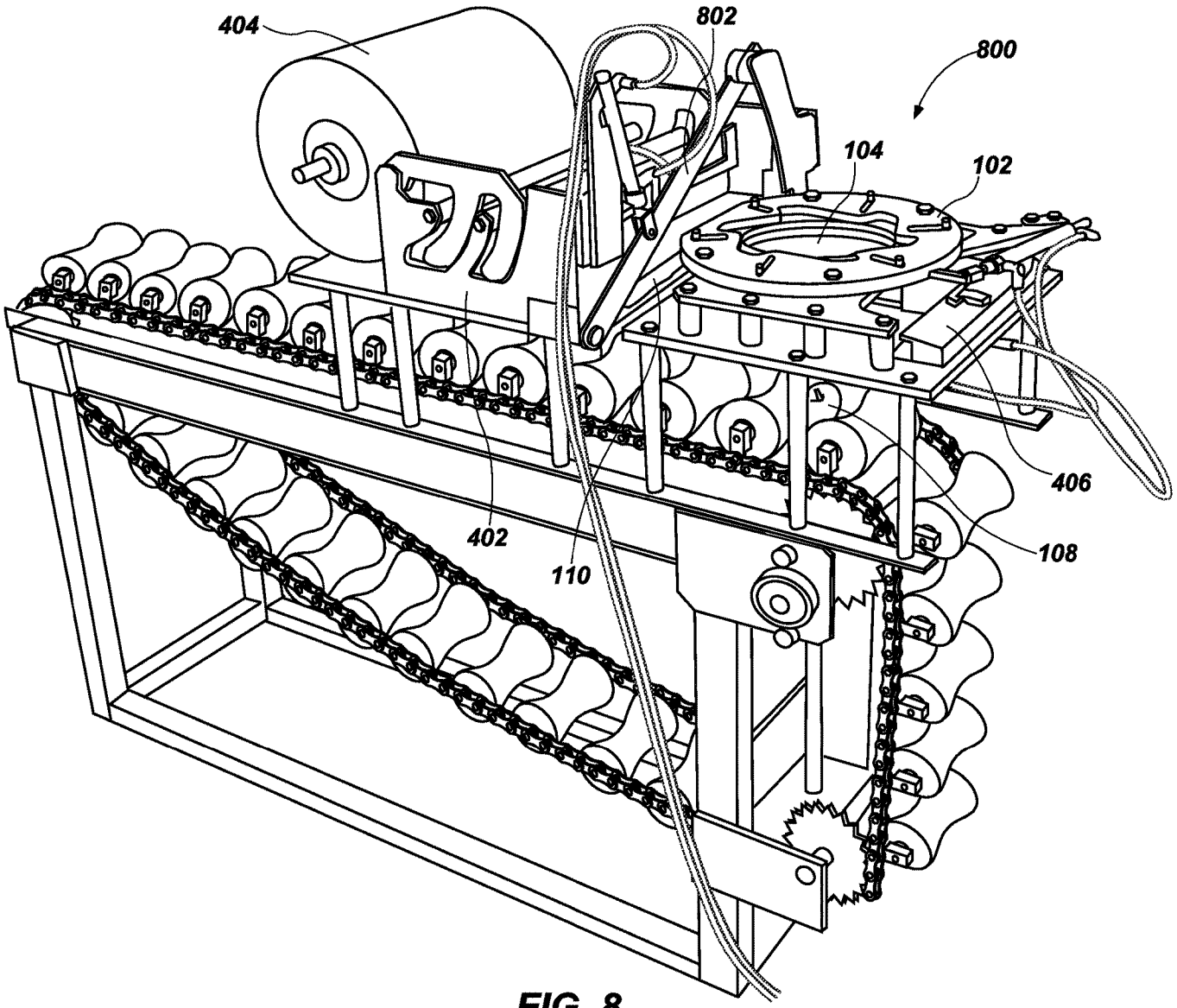
FIG. 8 is a perspective view of a wrapping material system, according to some embodiments.

FIG. 8 illustrates the wrapping material system 800. The wrapping material system 800 is one example of a system that is capable of positioning 204 wrapping material 110 between an object 108 and an aperture 104, as discussed above with reference to the method 200 of FIG. 2. The wrapping material system 800 includes a dispenser 402, a roll of wrapping material 404, a wrapping material positioning member 406, and a cutter 802 proximate to the dispenser 402. FIG. 8 also illustrates the contractible loop 102, the aperture 104, and the wrapping material 110.

The dispenser 402 is configured to dispense the wrapping material 110. For example, the dispenser 402 of FIG. 8 is configured to secure the roll of wrapping material 404 to enable the wrapping material 110 to be dispensed directly from the roll of wrapping material 404. The wrapping material positioning member 406 is configured to position the wrapping material 110 dispensed by the dispenser 402 between the object 108 and the aperture 104. The cutter 802 is configured to cut the wrapping material 110 into an appropriate segment sufficient to wrap the object 108.

The wrapping material 110 may include any of various different materials. In some embodiments, the wrapping material 110 includes a paper material (e.g., paper, wax paper, etc.). In some embodiments, the wrapping material 110 includes a synthetic material (e.g., plastic, polymer, regenerated cellulose, bubble wrap, etc.). In some embodiments, the wrapping material 110 includes a metal (e.g., tin foil, aluminum foil, etc.). In some embodiments, the wrapping material 110 includes a fabric (e.g., parchment, burlap, canvas, etc.).

In some embodiments the wrapping material 110 may be pre-cut into appropriately sized segments, and the dispenser 402 may be configured to dispense the segments. In such embodiments, the cutter 802 may not be used or may not be included in the wrapping material system 800. It should also be noted that it is contemplated within the scope of the disclosure that the wrapping material 110 may include a sack, and the wrapping material system 800 may be configured to position the sack between the object 108 and the aperture 104.

Figure 9:
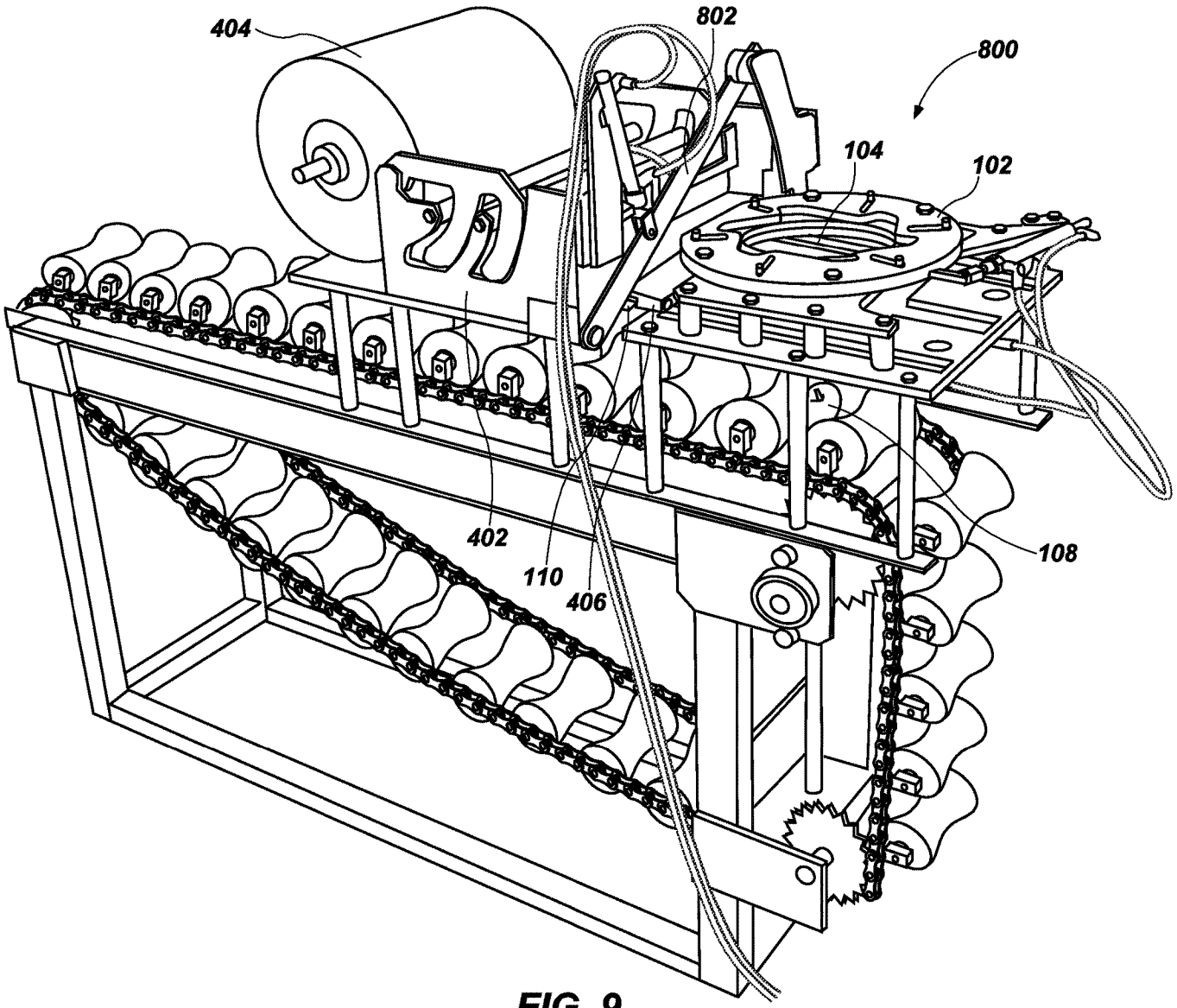
FIG. 9 is a perspective view of a wrapping material system, according to some embodiments.

Referring to FIGS. 7 and 9 together, the method 700 includes moving 702 the wrapping material positioning member 406 (e.g., a gripping member) to the dispenser 402 of the wrapping material 110. The method 700 also includes gripping 704, with the wrapping material positioning member 406 (e.g. the gripping member), a portion of the wrapping material 110 provided by the dispenser 402. FIG. 9 shows the wrapping material positioning member 406 moved to the dispenser 402 and gripping 704 the wrapping material 110.

Figure 10:
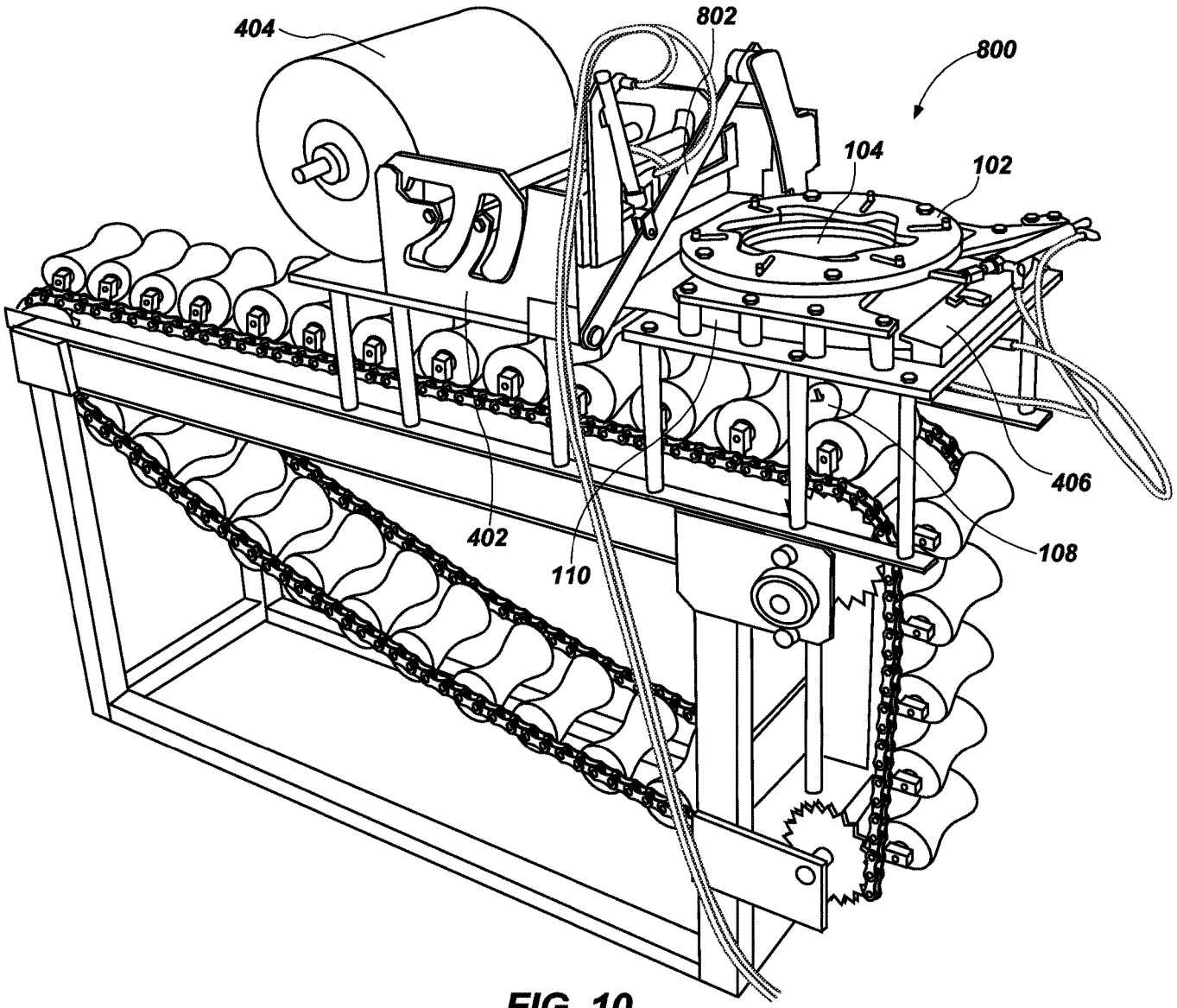
FIG. 10 is a perspective view of a wrapping material system, according to some embodiments.

Referring to FIGS. 7 and 10 together, the method 700 includes moving 706 the wrapping material positioning member 406 (e.g., the gripping member) away from the dispenser 402 to extend the wrapping material 110 between the object 108 and the aperture 104. FIG. 10 shows the wrapping material positioning member 406 moved 706 away from the dispenser 402, and back in the same position as shown in FIG. 8, but still gripping 704 the wrapping material 110. FIG. 10 also shows the wrapping material 110 extended between the object 108 and the aperture 104.

Figure 11:
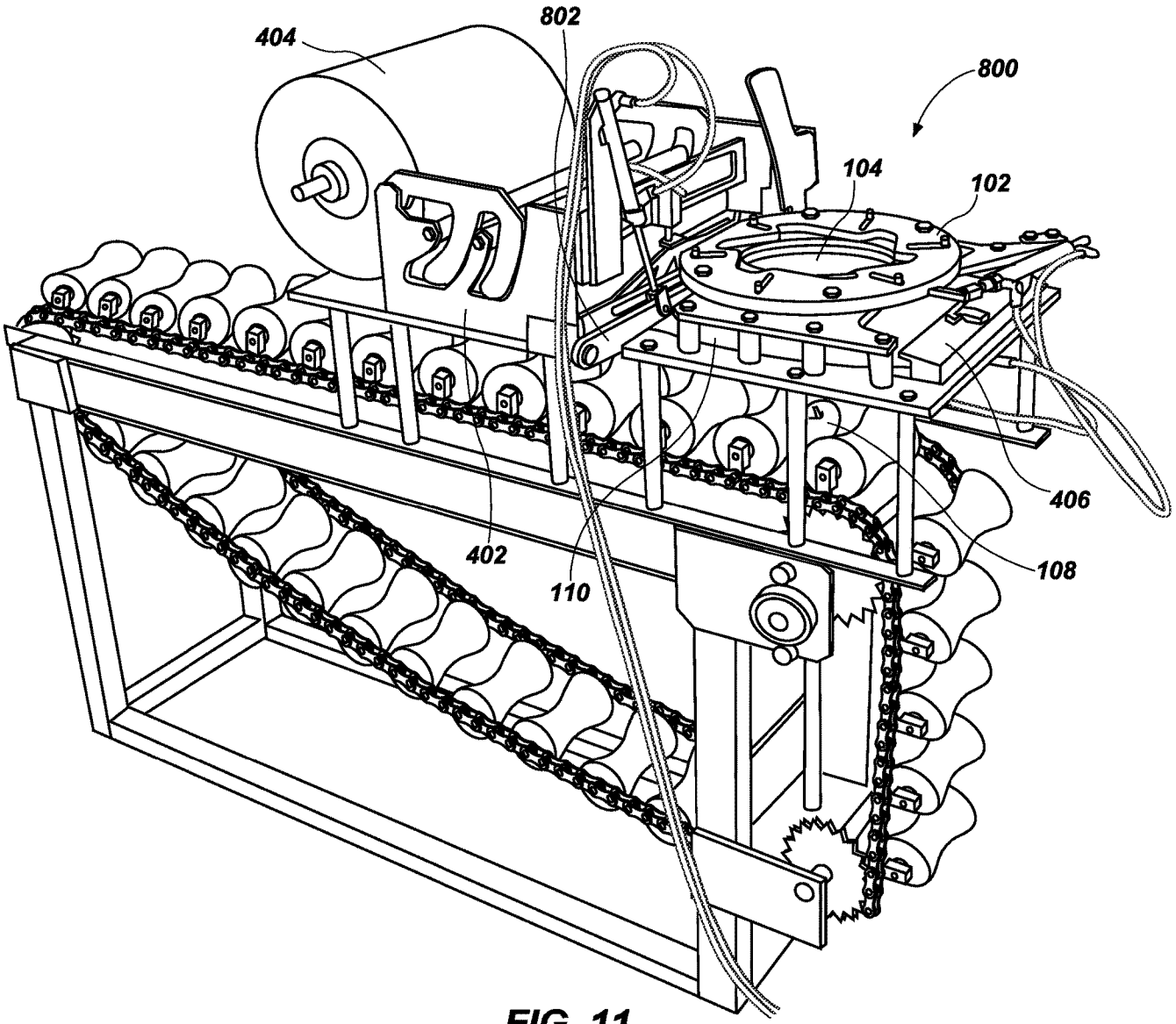
FIG. 11 is a perspective view of a wrapping material system, according to some embodiments.

Referring to FIGS. 7 and 11 together, the method 700 includes cutting 708 the wrapping material 110 proximate to the dispenser 402. FIG. 11 shows the cutter 802 in a lowered position, having cut 708 the wrapping material 110. For example, the cutter 802 may include a cutting blade on the bottom thereof to cut the wrapping material 110.

Figure 12:
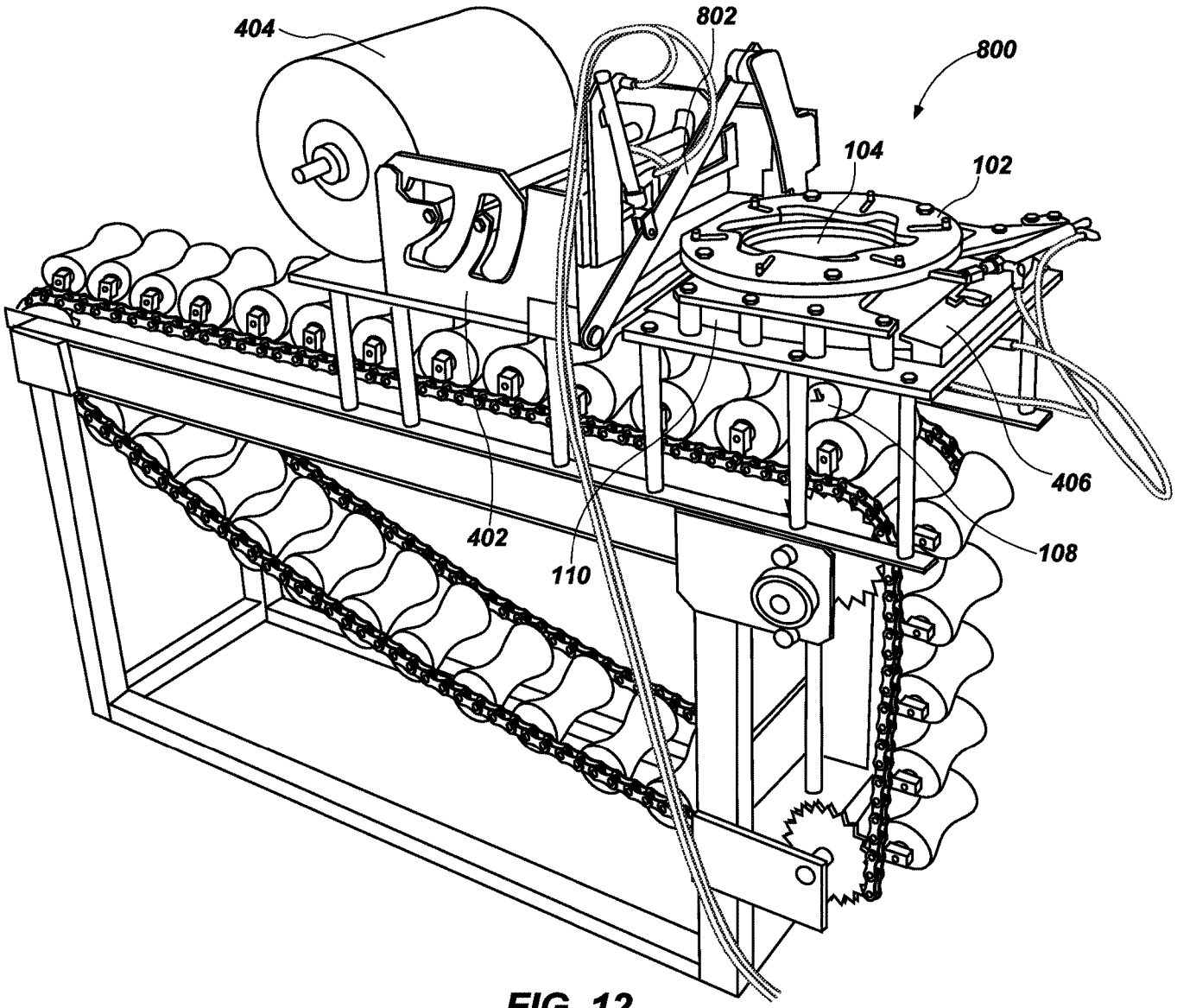
FIG. 12 is a perspective view of a wrapping material system, according to some embodiments.

Referring to FIGS. 7 and 12 together, the method 700 includes releasing 710 the wrapping material 110 with the wrapping material positioning member 406 (e.g., the gripping member). FIG. 12 illustrates the wrapping material 110 having been released by the wrapping material positioning member 406, and ready for the object 108 to be moved 206 into the wrapping material 110 and through the aperture 104.

Figure 13:
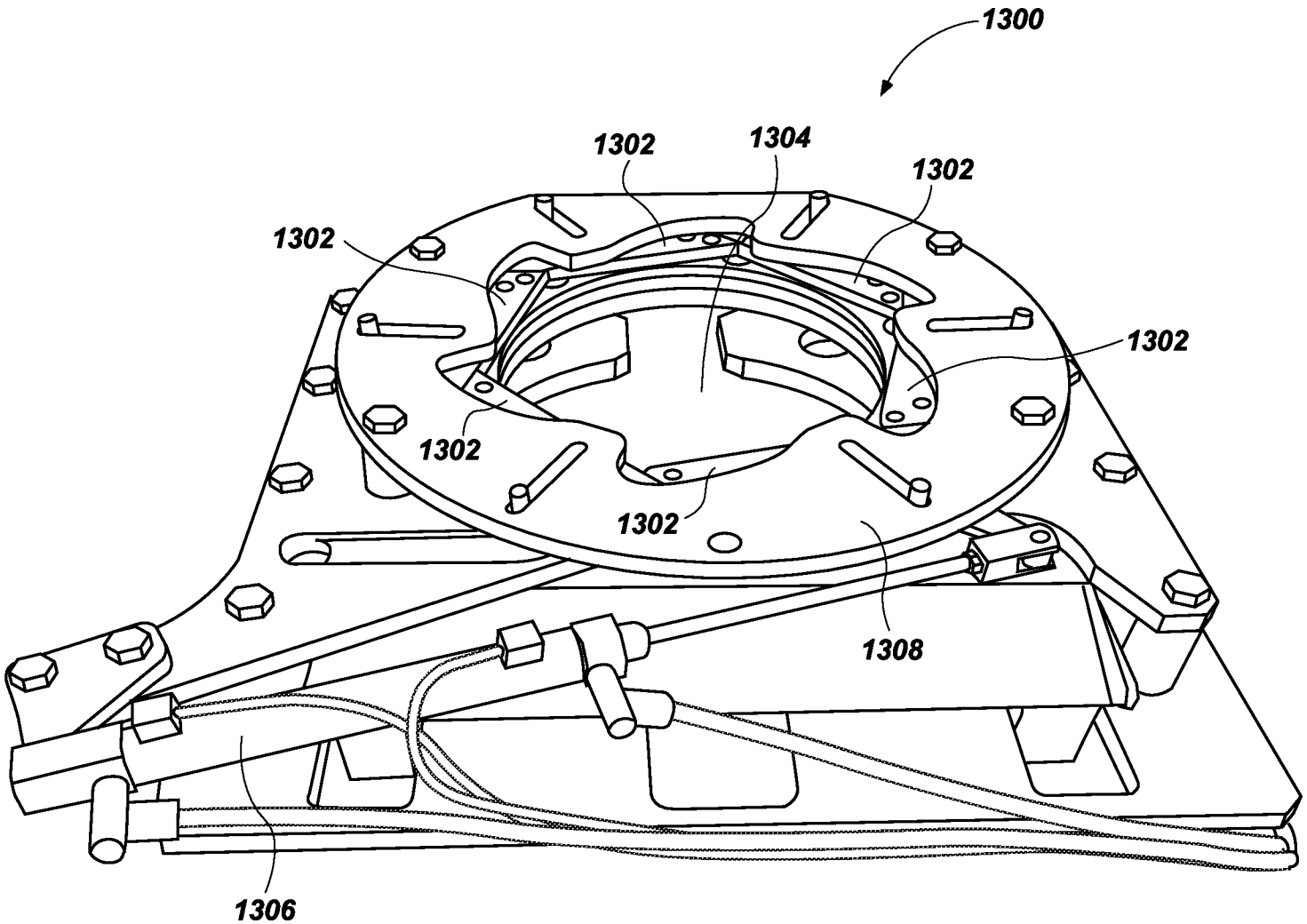
FIG. 13 is a perspective view of a contractible loop deployed in an expanded position, according to some embodiments.

FIG. 13 is a perspective view of a contractible loop 1300 deployed in an expanded position, according to some embodiments. The contractible loop 1300 is one example of the contractible loop 102 discussed above. The contractible loop 1300 includes a plurality of retractable members 1302 positioned in an at least substantially annular orientation. The plurality of retractable members 1302 define an aperture 1304. The aperture 1304 has a first area while the plurality of retractable members 1302 is deployed in a retracted position. FIG. 13 shows the plurality of retractable members 1302 deployed in the retracted position, which corresponds to the expanded position of the contractible loop 1300. The first area is sufficiently large to enable an object (e.g., the object 108 discussed above) that is to be wrapped to pass through the aperture 1304 when the plurality of retractable members 1302 is deployed in the retracted position. The contractible loop 1300 also includes a rigid annular member 1308 positioned proximate to the plurality of retractable members 1302 to provide mechanical support to the plurality of retractable members 1302 as the object is pushed through the aperture.

The contractible loop 1300 includes one or more retraction control members 1306. The one or more retraction control members 1306 are configured to extend the plurality of retractable members 1302 to an extended position (e.g., while or after the object is pushed through the aperture 1304) to close a wrapping material (e.g., the wrapping material 110 discussed above) around the object. The one or more retraction control members 1306 are also configured to retract the plurality of retractable members 1302 to the retracted position to enable the object to pass through the aperture 1304. By way of non-limiting example, the one or more retraction control members 1306 may include a piston, such as that shown in FIG. 14. Also by way of non-limiting example, the one or more retraction control members 1306 may include an actuator such as a servo motor. It will be understood that in some embodiments the plurality of retractable members 1302 may be controlled by other mechanical devices, if desired.

Figure 14:
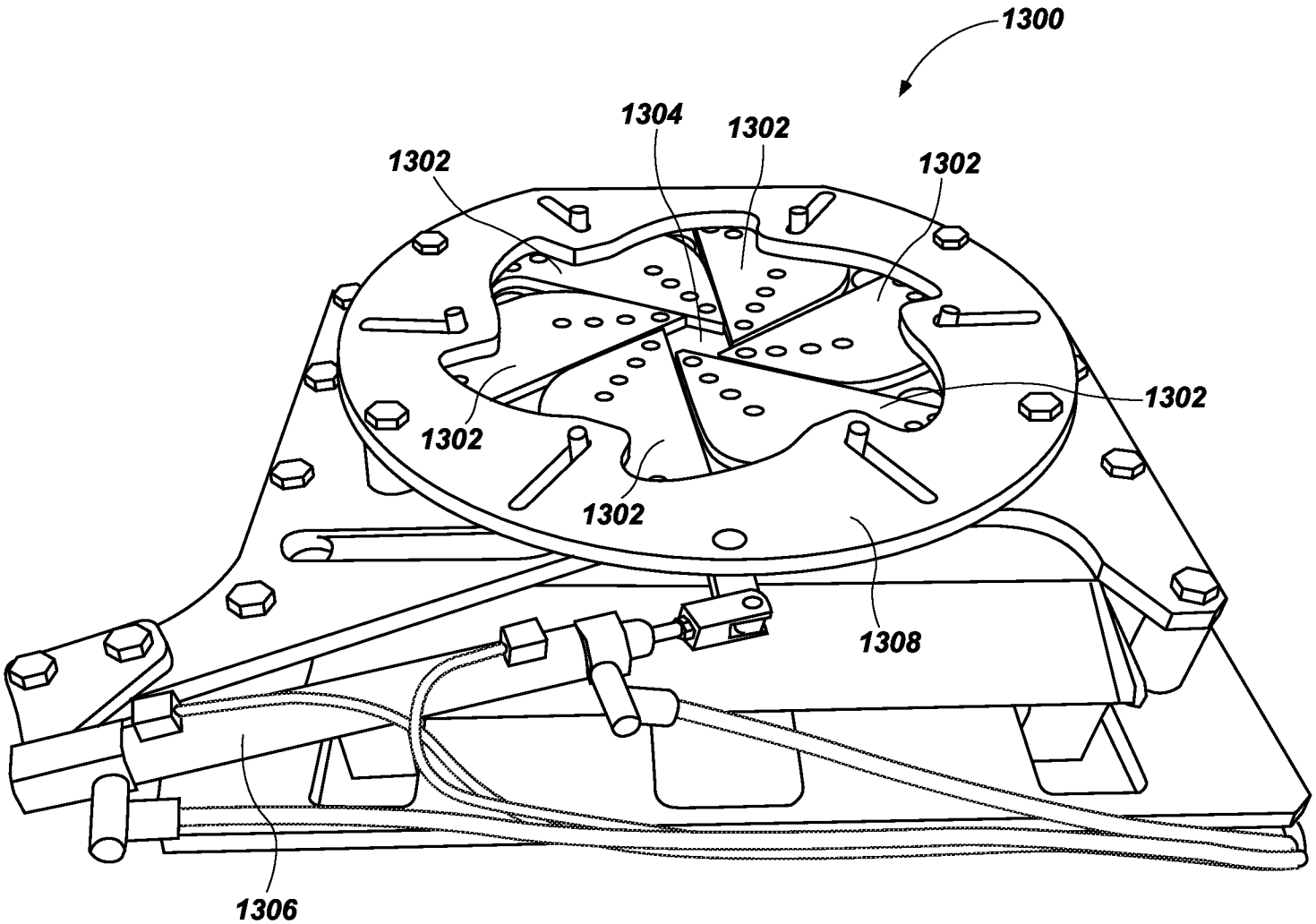
FIG. 14 is a perspective view of the contractible loop of FIG. 13 deployed in a contracted position.

FIG. 14 is a perspective view of the contractible loop 1300 of FIG. 13 deployed in a contracted position. The aperture 1304 has a second area while the plurality of retractable members 1302 is deployed in an extended position, which corresponds to the contracted position of the contractible loop 1300. FIG. 14 shows the plurality of retractable members 1302 deployed in the extended position. The first area of the aperture 1304 with the plurality of retractable members 1302 deployed in the retracted position (FIG. 13) is larger than the second area with the plurality of retractable members 1302 deployed in the expanded position.

Figure 15:
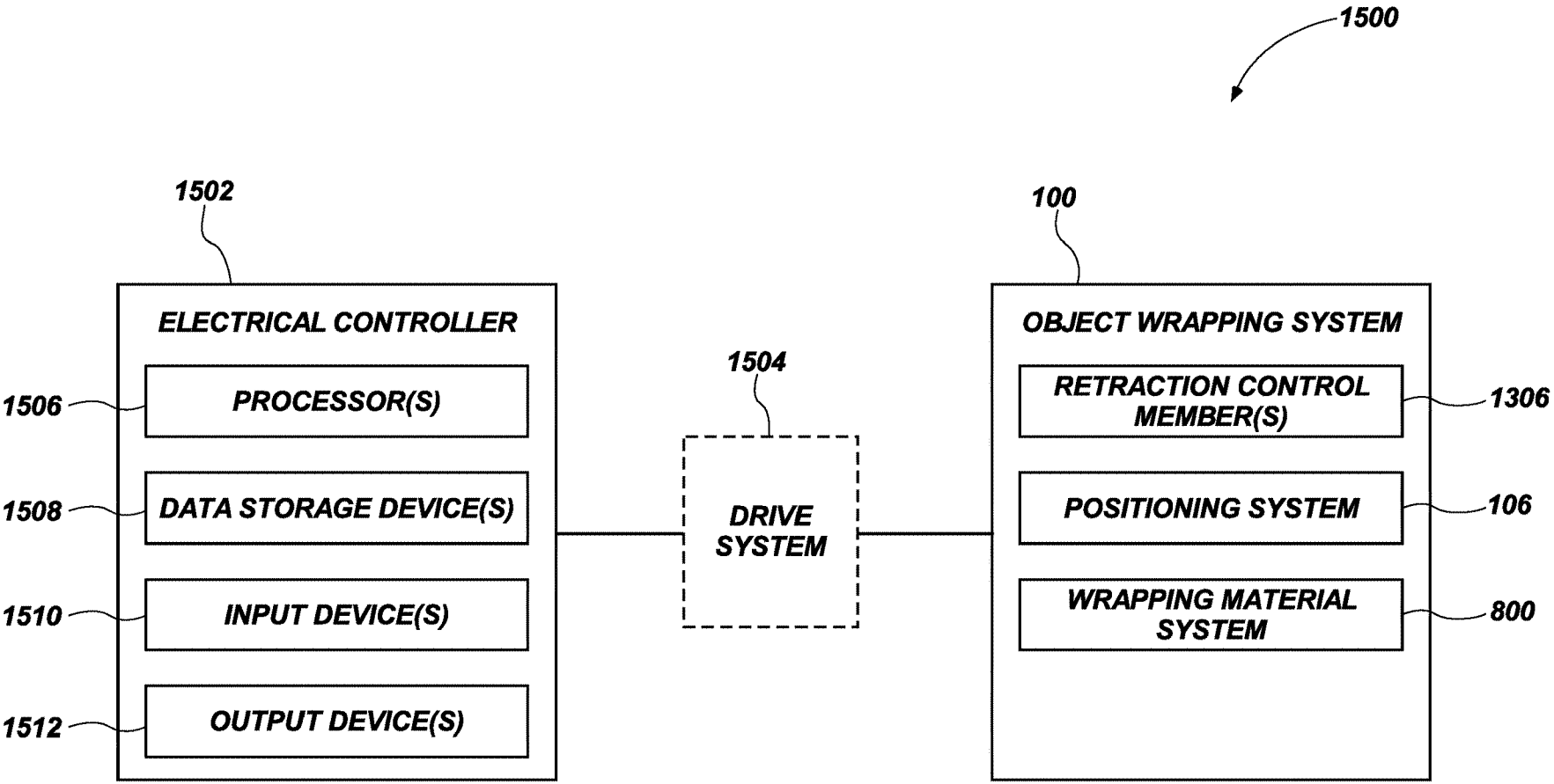
FIG. 15 is a block diagram of a control system, according to some embodiments.

FIG. 15 is a block diagram of a control system 1500, according to some embodiments. The control system 1500 includes an electrical controller 1502 configured to control various components (e.g., the one or more retraction control members 1306, the positioning system 106, the wrapping material system 800, etc.) of the object wrapping system 100. In some embodiments, the control system 1500 includes a drive system 1504, which is configured to mechanically drive various mechanical components of the object wrapping system 100. By way of non-limiting example, the one or more retraction control members 1306, the positioning system 106, and/or the wrapping material system 800 may include various pistons to control positions or deployments of their various components. The drive system 1504 may drive the mechanical components of the object wrapping system 100 pneumatically, hydraulically, electrically, or using some other driving force. Accordingly, in some embodiments the drive system 1504 may include a pneumatic drive system, a hydraulic drive system, an electrical drive system, some other drive system, or combinations thereof. The electrical controller 1502 may be operably coupled to the object wrapping system 100 using one or more electrical wires, one or more wireless communication interfaces (e.g., Bluetooth, Zigbee, Wifi, etc.), one or more pneumatic or hydraulic connections or tubes, or combinations thereof.

The electrical controller 1502 includes one or more processors 1506 operably coupled to one or more data storage devices 1508. The one or more processors 1506 may include a central processing unit (CPU) of a computer (e.g., a desktop computer, a laptop computer, a tablet computer, a smartphone, etc.), a microcontroller, a programmable logic controller (PLC), a field programmable gate array (FPGA), other programmable device, or combinations thereof. The one or more data storage devices 1508 may include volatile data storage (e.g., random access memory), non-volatile storage (e.g., a hard drive, a flash drive, electrically programmable read-only memory (EPROM), etc.), or cloud-based storage (implying a network interface to communicate with a cloud server).

The one or more data storage devices 1508 include computer-readable instructions stored thereon. The computer-readable instructions are configured to instruct the one or more processors 1506 to control the object wrapping system 100 (e.g., via the drive system 1504) to perform functions of the object wrapping system 100, which are discussed above. By way of non-limiting examples, the computer-readable instructions stored on the one or more data storage devices 1508 may be configured to instruct the one or more processors 1506 to control the object wrapping system 100 to perform at least a portion of the method 200 of FIG. 2, the method 700 of FIG. 7, other functions discussed herein, other methods within the scope of the disclosure, or combinations thereof.

In some embodiments the electrical controller 1502 may be configured to provide a user of the object wrapping system 100 control over the object wrapping system 100. For example, in some embodiments the electrical controller 1502 may include one or more input devices 1510 configured to accept user inputs to direct control of the object wrapping system 100. As specific, non-limiting examples, the one or more input devices 1510 may be configured to accept an on input configured to turn the object wrapping system 100 on, an off input configured to turn the object wrapping system 100 off, speed control inputs configured to control a speed of operation of the object wrapping system 100, other inputs, or combinations thereof. In some embodiments the one or more input devices 1510 may include a touch-screen input sensor, a keypad, one or more buttons, a trackpad, a mouse, other input devices, or combinations thereof.

In some embodiments the electrical controller 1502 includes one or more output devices 1512 to provide information to a user regarding operation of the object wrapping system 100. For example, the one or more output devices 1512 may be configured to indicate a status of operation of the object wrapping system 100, indicate failures in operations of the object wrapping system 100 (e.g., alarms), indicate other information, or combinations thereof. In some embodiments the one or more output devices 1512 may include an electronic display, one or more audio devices (e.g., alarms, speakers, horns, bells, etc.), one or more lights (e.g., status lights, warning lights, etc.), other output devices, or combinations thereof.

It will be apparent to those of ordinary skill in the art that many variations may be made on the embodiments and examples discussed herein without deviating from the scope of the disclosure.

What is claimed is:

1. An object wrapping system, comprising:

a contractible loop configured to be deployed in an expanded position in which an aperture defined by the contractible loop has a first area, the contractible loop also configured to be deployed in a contracted position in which the aperture has a second area that is smaller than the first area;

a positioning system comprising a positioning member which extends through the contractible loop, the positioning member configured to position an object in alignment with the aperture; and a wrapping material system configured to position a wrapping material proximate the object;

wherein the contractible loop is configured to deploy into the contracted position to at least partially close the wrapping material around the object; and wherein the wrapping material system comprises a wrapping material positioning member configured to release the wrapping material before the positioning system moves the object into the wrapping material.

2. The object wrapping system of claim 1, wherein the contractible loop has an at least substantially annular shape.

3. The object wrapping system of claim 1, wherein the contractible loop has a shape different from an annular shape.

4. The object wrapping system of claim 1, wherein the wrapping material system includes a dispenser of the wrapping material, wherein the wrapping material positioning member is configured to grip the wrapping material dispensed by the dispenser and extend the wrapping material across the aperture.

5. The object wrapping system of claim 4, wherein the wrapping material system further comprises a cutter configured to cut the wrapping material after the wrapping material positioning member extends the wrapping material across the aperture.

6. The object wrapping system of claim 1, wherein the positioning system comprises a conveyor system configured to assist the positioning member in positioning the object in alignment with the aperture.

7. A method of wrapping an object, the method comprising:

positioning an object in alignment with an aperture defined by a contractible loop using a positioning member which extends through the contractible loop;

positioning a wrapping material between the object and the aperture with a wrapping material positioning member;

contracting the contractible loop into a contracted position in which the aperture has a second area that is smaller than the first area, wherein contracting the contractible loop at least partially closes the wrapping material around the object; and releasing the wrapping material from the wrapping material positioning member before the object moving device moves the object into the wrapping material.

8. The method of claim 7, wherein positioning an object in alignment with an aperture defined by a contractible loop comprises positioning the object on a conveyor system.

9. The method of claim 7, wherein positioning a wrapping material between the object and the aperture comprises:

moving a gripping member to a dispenser of the wrapping material;

gripping, with the gripping member, a portion of the wrapping material provided by the dispenser; and moving the gripping member away from the dispenser to extend the wrapping material between the object and the aperture.

10. The method of claim 7, wherein positioning a wrapping material is performed before positioning an object.

11. The method of claim 7, wherein contracting the contractible loop into a contracted position comprises extending a plurality of retractable members arranged in an at least substantially annular orientation from a retracted position to an extended position.

12. An object wrapping system, comprising:

a plurality of retractable members arranged in an at least substantially annular orientation to define an aperture, the aperture having a first area while the plurality of retractable members is deployed in a retracted position and a second area while the plurality of retractable members is deployed in an extended position, the first area larger than the second area;

a positioning system comprising a positioning member which extends through the aperture, the positioning member configured to position an object in alignment with the aperture;

a wrapping material positioning member configured to position a wrapping material proximate to the aperture; and one or more retraction control members configured to extend the plurality of retractable members to the extended position to close the wrapping material around the object;

wherein the wrapping material positioning member is configured to release the wrapping material before the positioning member moves the object into the wrapping material.

13. The object wrapping system of claim 12, wherein the first area is larger than the object.

14. The object wrapping system of claim 12, wherein the second area is smaller than the object.

15. The object wrapping system of claim 12, wherein the one or more retraction control members are configured to retract the plurality of retractable members to the retracted position.

16. The object wrapping system of claim 12, wherein the at least substantially annular orientation of the plurality of retractable members is at least substantially horizontal.

17. The object wrapping system of claim 16, wherein the positioning member is configured to position the object below the aperture.

18. The object wrapping system of claim 12, wherein the positioning member is sufficiently small to pass through the aperture after the one or more retraction control members extend the plurality of retractable members into the extended position to close the wrapping material around the object.

19. The object wrapping system of claim 12, further comprising a rigid annular member positioned proximate to the plurality of retractable members to provide mechanical support to the plurality of retractable members as the object is moved through the aperture.

20. The object wrapping system of claim 12, further comprising an electrical controller configured to control operation of at least one of the one or more retraction control members, the wrapping material positioning member, or the object moving device.

* * * * *